US011299323B2

(12) United States Patent
Kalsi et al.

(10) Patent No.: US 11,299,323 B2
(45) Date of Patent: Apr. 12, 2022

(54) FILAMENT PAD OR LINER FOR HOLDING JEWELRY AND OTHER SIMILAR ITEMS

(71) Applicants: Jasmeeth Kalsi, East Meadow, NY (US); Tejan Arora, East Meadow, NY (US)

(72) Inventors: Jasmeeth Kalsi, East Meadow, NY (US); Tejan Arora, East Meadow, NY (US)

( * ) Notice: Subject to any disclaimer, the term of this patent is extended or adjusted under 35 U.S.C. 154(b) by 0 days.

(21) Appl. No.: 16/029,079

(22) Filed: Jul. 6, 2018

(65) Prior Publication Data

US 2019/0009948 A1 Jan. 10, 2019

Related U.S. Application Data

(60) Provisional application No. 62/529,506, filed on Jul. 7, 2017.

(51) Int. Cl.

| | |
|---|---|
| ***B65D 25/10*** | (2006.01) |
| ***B65D 81/05*** | (2006.01) |
| *A47F 7/02* | (2006.01) |
| *A45C 11/16* | (2006.01) |
| *B65D 85/38* | (2006.01) |

(52) U.S. Cl.

CPC ..... *B65D 25/10* (2013.01); *B65D 81/05* (2013.01); *A45C 11/16* (2013.01); *A47F 7/02* (2013.01); *B65D 85/38* (2013.01)

(58) Field of Classification Search

CPC ..... B65D 81/05; B65D 85/38; B65D 25/10; A45C 11/16; A47F 7/02

USPC ..... 206/483, 477, 478, 480, 6.1

See application file for complete search history.

(56) References Cited

U.S. PATENT DOCUMENTS

| | | | | |
|---|---|---|---|---|
| D56,314 | S | 9/1920 | Viggiano | |
| 1,373,097 | A | 3/1921 | Roda | |
| 1,960,073 | A | 5/1934 | Warner | |
| D150,059 | S | 6/1948 | Davis | |
| 4,082,390 | A | 4/1978 | Gibson et al. | |
| 4,181,224 | A | 1/1980 | Aber | |
| 4,264,013 | A | 4/1981 | Vollmer | |
| 4,325,484 | A * | 4/1982 | Berry | A01K 97/08 211/66 |
| 4,413,736 | A | 11/1983 | Nibling | |
| 4,420,084 | A | 12/1983 | Whelan | |
| 4,704,759 | A * | 11/1987 | Mesa | A47K 7/024 15/110 |
| D297,283 | S | 8/1988 | Gray | |
| 4,775,584 | A | 10/1988 | LeBarge | |
| 4,787,516 | A | 11/1988 | Morrison | |
| 4,821,883 | A | 4/1989 | Miller | |
| 4,848,589 | A | 7/1989 | Olson et al. | |
| 4,907,704 | A | 3/1990 | Souders | |
| 4,945,598 | A * | 8/1990 | Racioppi | A45D 27/29 15/160 |
| 4,966,287 | A | 10/1990 | Snyder | |

(Continued)

*Primary Examiner* — Steven A. Reynolds

(74) *Attorney, Agent, or Firm* — The Roy Gross Law Firm, LLC; Roy Gross

(57) ABSTRACT

A method and system of and for securing and/or transporting fragile or valuable items such as jewelry, small medical, scientific, or industrial instruments, or similar items, which can be damaged or lose value due to rough or negligent handling and/or shipping, the method and system including a plurality of cooperative filaments or bristles onto and into which an item is placed.

19 Claims, 3 Drawing Sheets

(56) References Cited

U.S. PATENT DOCUMENTS 5,009,333 A 4/1991 Souders
5,054,624 A * 10/1991 Camp ..... A47F 5/02 211/163
5,069,332 A 12/1991 Williams et al.
5,175,896 A * 1/1993 Zamir ..... A47K 7/024 15/160
5,176,263 A 1/1993 Caruso
5,242,048 A 9/1993 Ellingsworth et al.
5,358,100 A 10/1994 Wolff
5,363,953 A 11/1994 Carter
5,427,230 A 6/1995 Mattox
5,450,970 A * 9/1995 Mitchell ..... A45D 24/38 211/65
5,671,849 A 9/1997 Bacon
5,680,928 A 10/1997 Carr
5,738,228 A * 4/1998 Bittinger ..... A47F 7/0021 211/60.1
5,758,936 A 6/1998 Baughan
5,779,033 A 7/1998 Roegner
5,915,572 A * 6/1999 Hancock ..... A47B 81/005 211/64
6,685,023 B2 * 2/2004 Bleggi ..... A45C 11/16 206/493
7,100,808 B2 * 9/2006 Hancock ..... F16L 3/10 224/547
D629,608 S 12/2010 Hong
D631,251 S 1/2011 Hong
7,946,424 B2 * 5/2011 Gupta ..... B65D 81/1075 206/575
8,151,980 B2 4/2012 DeMartino
9,408,479 B2 8/2016 Hasbany
2004/0164034 A1 8/2004 Costanza
2006/0011085 A1 * 1/2006 Whitley ..... F42B 4/20 102/343
2014/0048428 A1 * 2/2014 Sakamoto ..... A45C 11/16 206/6.1
2016/0309886 A1 * 10/2016 Oldham ..... A46B 9/02
2016/0318661 A1 * 11/2016 Simakis ..... A45F 5/021

* cited by examiner

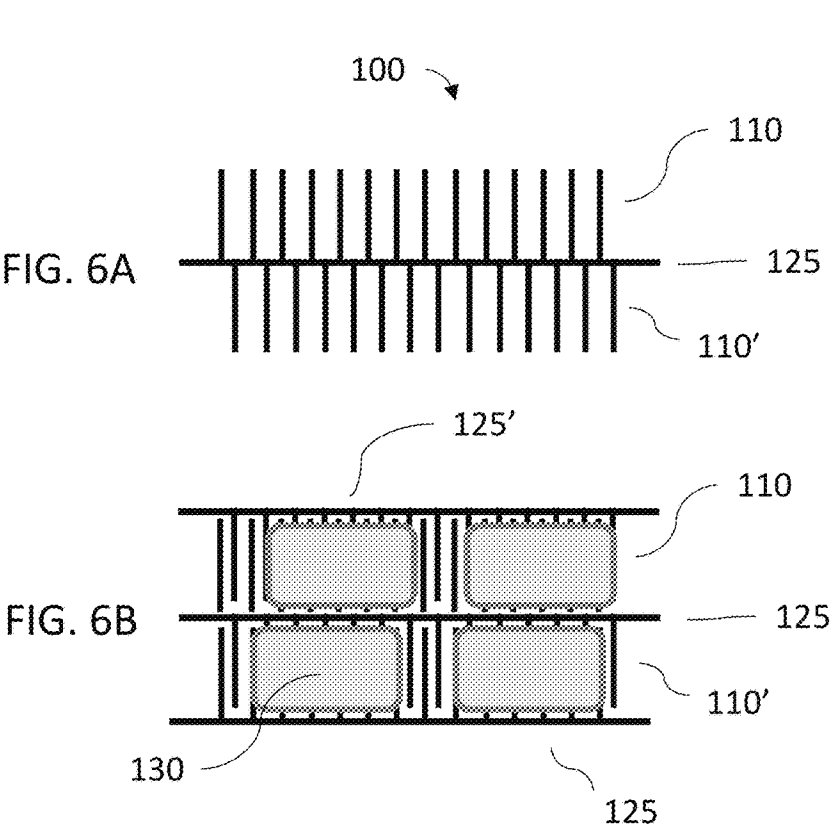
FIG. 6A
FIG. 6B
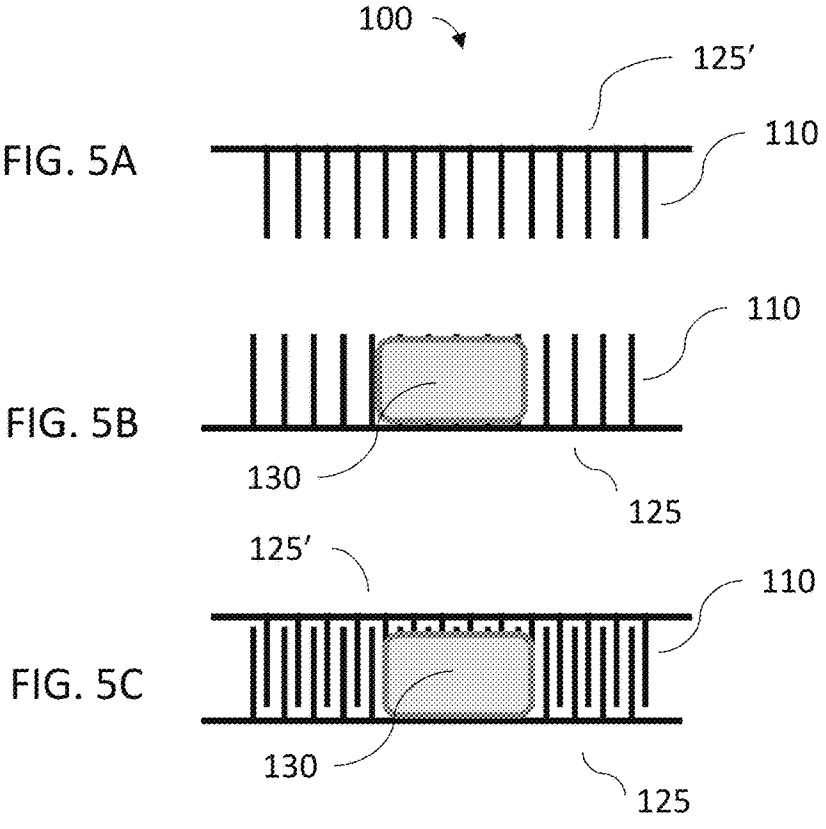
FIG. 5A
FIG. 5B
FIG. 5C

FILAMENT PAD OR LINER FOR HOLDING JEWELRY AND OTHER SIMILAR ITEMS

CROSS REFERENCE TO RELATED APPLICATIONS

This application claims the benefit of Provisional U.S. Patent Application Ser. No. 62/529,506, entitled FILAMENT PAD LINER FOR HOLDING JEWELRY AND OTHER SIMILAR ITEMS, filed Jul. 7, 2017; and, hereby is incorporated in its entirety by reference.

FIELD OF THE INVENTION

The present invention relates to holders, and/or carriers for securing and/or transporting fragile or valuable items such as jewelry, small medical, scientific, or industrial instruments, or similar items, which can be damaged or lose value due to rough or negligent handling and/or shipping. More specifically, the present invention relates to holders, and/or carriers for securing and/or transporting fragile or valuable items, the holder and/or carrier including a plurality of cooperative filaments or bristles onto and into which an item is placed.

BACKGROUND OF THE INVENTION

Small, delicate, or high value items as for example jewelry, and additionally, small medical, scientific, or industrial instruments or components such as precision tools, small medical instruments or instrument components such as surgical cutting or suturing tools or components, prove difficult to organize, handle, and store for repeated daily use, and/or store for warehousing and/or shipping.

Typically, though, such containers, unless used for long distance shipment, are designed and intended for storing items for repeated or daily use; such items and containers are commonly placed on the top of a dresser or in a drawer, on a cosmetics table, on an examination or surgical table, on a scientific or industrial work station—and the like.

As in the case of common yet many times extremely expensive or priceless items such as jewelry, rings, brackets, necklaces, earrings, broches, or other such items, when not being used or worn, are placed in containers colloquiality called "jewelry boxes, drawers, or safes". Such "jewelry box" type containers commonly have soft cushioned interiors covered with felt or other non-abrasive type lining. Common "ring boxes" typically comprise at least two padded and felt covered berms or portions creating a cavity, crevasse, or channel into which individual rings are placed. A commonly known alternative "ring box" may comprise a cylindrical padded and/or felt covered "finger" of various diameters and configurations where literally the container wears the ring. Used by jewelry manufacturers, distributers, and salespersons; a plurality of padded and nested trays used alone or with protective cabinets are also known.

In the case of storing and/or shipping of earrings and chain necklace jewelry, typical known boxes or containers comprise small compartments or compartmented drawers to hold and protect such items. Disadvantageously however, such known compartmentalized systems fail to prevent shifting or movement of small items resulting tangled chains and other damage caused by item movement.

Because of their high cost and at times fragility, small medical, scientific, or industrial instruments or components such as precision tools, small medical instruments or instrument components, also prove difficult to organize, handle, and store for repeated daily use, and/or store for warehousing and/or shipping.

Existing systems include: D150,059. D297,283, D629,608. D631,251, U.S. Pat. Nos. 1,373,097, 1,960,073, 3,804,239, 4,082,390, 4,181,224. U.S. Pat. Nos. 4,264,013, 4,413,736, 4,420,084, 4,775,584, 4,787,516, 4,821,883, 4,848,589, 4,907,704, 4,966,287, 5,009,333, 5,096,332, 5,176,263, 5,242,048. U.S. Pat. Nos. 5,358,100, 5,363,953, 5,427,230, 5,671,849, 5,680,928, 5,575,936, 5,779,003, 6,685,023, 8,151,980, 9,408,479, and US20040164034.

Disadvantageously however, all known systems fail to provide a functional and effective balance between securing and protecting such items, and allowing for both repeated use and item protection during storing and/or shipping.

Attempting to overcome these disadvantages by both manufacturers and end users of known holders or containers, it is common for generic polyurethane foam or similar characteristic material to be custom cut and fit into known existing handling, storage, and shipping boxes or containers; which disadvantageously adds weight and space to such containers and labor time and cost during container manufacture.

Moreover, cushioning material such as polyurethane foam and other types of polymers and synthetic materials, as well as other suitable natural material cushioning, degrade over time and thus become unusable and must be replaced.

It is desired to provide a method and system that solves the disadvantages in the prior art.

SUMMARY OF THE INVENTION

It is an object of the present invention to provide a method and system of and for holding, carrying, securing and/or transporting fragile or valuable items which can be damaged or lose value due to rough or negligent handling and/or shipping, such as but not limited to jewelry, small medical, scientific, or industrial instruments or components, or similar items; the inventive holder and/or carrier including a plurality of cooperative filaments or bristles onto and into which an item is placed.

It is an object of the present invention to provide a method and system for holding, carrying, securing and/or transporting fragile or valuable items including a plurality of cooperative filaments or bristles onto and into which an item is placed; wherein the filaments have a distal end and a proximal end, the proximal end affixed to a common base.

Objects of the invention are achieved by providing a system of and for holding, carrying, securing or transporting a fragile or valuable item comprising: a common base; and a plurality of cooperative filaments or bristles each having a distal end and a proximal end, the proximal ends affixed to the common base; wherein the item placed thereon and/or there-in-between the plurality of cooperative filaments or bristles is protected from inadvertent damage or loss.

In certain embodiments, the common base and/or the at least a portion of the plurality of the filaments or bristles are configured to hold more than one item.

In certain embodiments, the common base and/or the at least a portion of the plurality of the filaments or bristles are configured to be used with and to improve known and existing holders or containers from the group consisting of: jewelry boxes, jewelry drawers, jewelry safes, compartmentalized boxes or cases, storage containers, shipping containers, and combinations thereof.

In certain embodiments, the common base and/or the at least a portion of the plurality of the filaments or bristles comprise a natural material.

In certain embodiments, the common base and/or the at least a portion of the plurality of the filaments or bristles comprise a synthetic material.

In certain embodiments, the common base and/or the at least a portion of the plurality of the filaments or bristles comprise a polymer or plastic.

In certain embodiments, the common base and/or the at least a portion of the plurality of the filaments or bristles are ridged.

In certain embodiments, the common base and/or the at least a portion of the plurality of the filaments or bristles are semi-ridged.

In certain embodiments, the common base and/or the at least a portion of the plurality of the filaments or bristles are flexible.

In certain embodiments, the common base and/or the at least a portion of the plurality of the filaments or bristles are substantially straight.

In certain embodiments, the common base and/or the at least a portion of the plurality of the filaments or bristles are substantially curved.

In certain embodiments, at least a portion of the plurality of the filaments or bristles are substantially configured in a spiral or corkscrew.

In certain embodiments, at least a portion of the plurality of the filaments or bristles project inwards towards the center of the common base.

In certain embodiments, at least a portion of the plurality of the filaments or bristles project outwards away from the center of the common base.

In certain embodiments, at least a portion of the plurality of the filaments or bristles project outwards and straight away from the center of the common base.

In certain embodiments, at least a portion of the plurality of the filaments or bristles are of equal length.

In certain embodiments, at least a portion of the plurality of the filaments or bristles are of various lengths.

In certain embodiments, at least a portion of the plurality of the filaments or bristles are half the length of other cooperative filaments or bristles.

In certain embodiments, at least a portion of the plurality of the filaments or bristles are of one circumference at the distal end, and of another circumference at the proximal end.

In certain embodiments, at least a portion of the plurality of the filaments or bristles are of a number of filaments per square inch allowing an item to slip between the filaments or bristles and rest on the common base without causing deflection of the filaments or bristles by the item.

Other objects of the invention are achieved by providing a method of and for holding, carrying, securing or transporting a fragile or valuable item comprising the steps of: providing a common base; and providing a plurality of cooperative filaments or bristles each having a distal end and a proximal end, the proximal ends affixed to the common base; wherein placing the item thereon and/or there-in-between the plurality of cooperative filaments or bristles protects the item from inadvertent damage or loss.

In certain embodiments, the common base and/or the at least a portion of the plurality of the filaments or bristles are configured to hold more than one item.

Other objects of the invention and its particular features and advantages will become more apparent from consideration of the following drawings and accompanying detailed description. It should be understood that the detailed description and specific examples, while indicating the preferred embodiment of the invention, are intended for purposes of illustration only and are not intended to limit the scope of the invention.

BRIEF DESCRIPTION OF THE DRAWINGS

FIG. 5A is a side-view schematic diagram of an embodiment of the inventive system and method comprising a plurality of filaments or bristles affixed to a common base.

FIG. 5B is a side-view schematic diagram of an embodiment of the inventive system and method comprising a plurality of filaments or bristles affixed to a common base and holding an item.

FIG. 5C is a side-view schematic diagram of an embodiment of the inventive system and method comprising a plurality of filaments or bristles affixed to a common base holding an item between another identical or similar common base.

FIG. 6A is a side-view schematic diagram of an embodiment of the inventive system and method comprising a plurality of filaments or bristles affixed to a common base including a plurality of filaments or bristles affixed to the opposing side of the common base.

FIG. 6B is a side-view schematic diagram of an embodiment of the inventive system and method comprising a plurality of filaments or bristles affixed to a common base including a plurality of filaments or bristles affixed to the opposing side of the common base and holding items.

DETAILED DESCRIPTION OF THE INVENTION

Figures 2A, 2B, 2C:
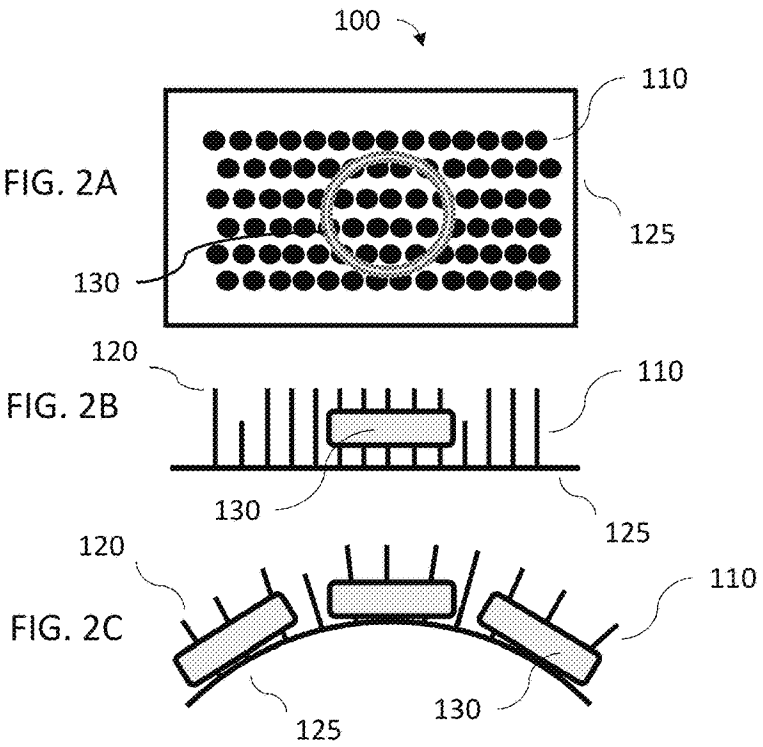
FIG. 2A is a top-view schematic diagram of an embodiment of the inventive system and method comprising a plurality of filaments or bristles affixed to a common base and holding an item.
FIG. 2B is a side-view schematic diagram of an embodiment of the inventive system and method comprising a plurality of filaments or bristles affixed to a common base and holding an item.
FIG. 2C is a side-view schematic diagram of an embodiment of the inventive system and method comprising a plurality of filaments or bristles affixed to a curved common base and holding an item.

In the following description, numerous details are set forth for the purpose of explanation. However, one of ordinary skill in the art will realize that the invention may be practiced without the use of these specific details.

For ease of understanding and conceptual visualization, the inventive filament or bristle type pad or liner for holding items is similar to a common either curved or flat hair brush. Depending upon the density and type of bristles on a hair brush, if the brush is placed flat on a surface, bristles up, then items such as rings or chain necklaces may be placed on and between the bristles of the brush for safekeeping and easy access storage. If another similar or identical hair brush is then placed bristles down on top of the item and the first brush and secured in some fashion—then the items could and can be moved, packed, and shipped without damage and/or scratching the items.

Furthermore, the inventive system holds objects such as jewelry or tools in a secure elevated position from knocking over or touching against each other or surfaces that may scratch or contaminate them.

In certain embodiments, the physical structure of the holder is built similar to a plastic bristled hairbrush with an arched cushion in the middle to allow soft flexibility to pick up objects placed thereon. The base of the holder can be made of any combination of materials, including woods, metals, plastics. The base can include a weight and rubberized surface to help keep it from sliding on surfaces. The bristles would be constructed of materials that will not damage tools or jewelry.

In certain embodiments, the holder functions to hold objects in place from being easily knocked over when compared to, for example, traditional jewelry plates or other similar holders. Depending on the design, the bristles can help keep objects elevated from touching the bottom surface and increasing the chance of objects coming into contact with each other and prevent unwanted scratching or cross contamination.

In certain embodiments, the holder can be used on a night stand, next to a sink, or anywhere where jewelry is taken off and placed down. Other applications may include using waterproof or medical grade silicon base and bristles to hold objects near a water source such as a sink cooking or surgical tools that cannot touch each other.

In certain embodiments, the holder can be used as a medical grade holder to hold surgical tools, have a waterproof design for use near sinks, have a heatproof/Fire retardant construction for use in kitchens or mechanic workshops.

In certain embodiments, the holder has a clamshell design for travel, built-in night-light, speaker, radio, alarm clock, cellphone dock or other constructions that make the device have multiple uses.

As depicted in FIG. 1-6, in a similar way, the inventive method and system (100) comprises a plurality of cooperative filaments or bristles (110) wherein the filaments have a distal end (115) and a proximal end (120), the proximal end being affixed to a common base (125), wherein the common base being placed on a surface or in a container is capable if cradling or holding an item (130) for use, storage, and/or shipment.

It is contemplated that the inventive method and system (100) comprising a plurality of cooperative filaments or bristles (110) wherein the filaments have a distal end (115) and a proximal end (120), the proximal end being affixed to a common base (125), may be placed in known and existing containers, such as jewelry boxes, drawers, and safes; and be of a plurality of configurations depending upon the items being protected and/or stored.

It is contemplated that the inventive method and system (100) may be used to line the compartments of so called tackle boxes, or other similar containers, to protect and secure items.

It is contemplated that the inventive method and system (100) may be used on the shelf, dresser or in a drawer of a person's home.

Figures 1A, 1B, 1C:
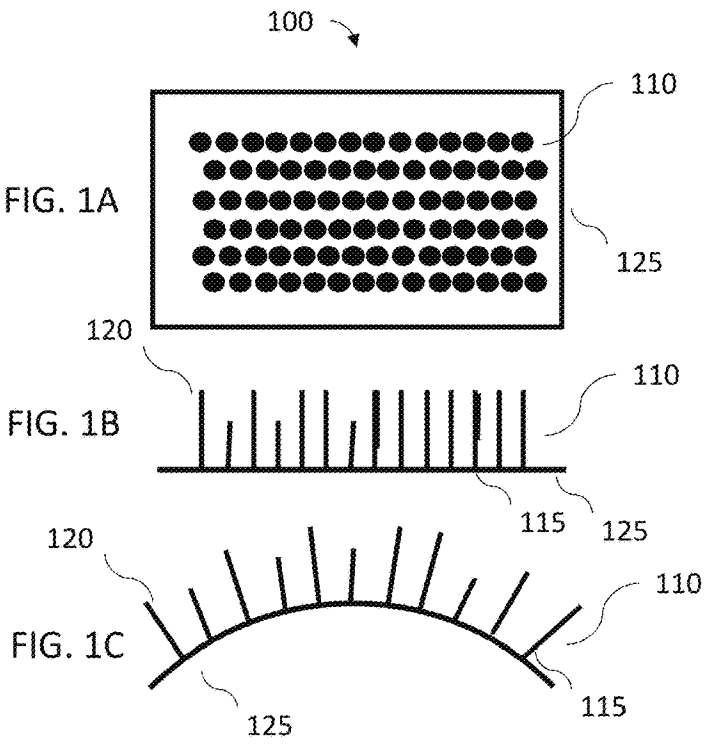
FIG. 1A is a top-view schematic diagram of an embodiment of the inventive system and method comprising a plurality of filaments or bristles affixed to a common base.
FIG. 1B is a side-view schematic diagram of an embodiment of the inventive system and method comprising a plurality of filaments or bristles affixed to a common base.
FIG. 1C is a side-view schematic diagram of an embodiment of the inventive system and method comprising a plurality of filaments or bristles affixed to a curved common base.

Similar to as depicted in FIG. 1B, in certain embodiments, the inventive method and system (100) comprises a plurality of cooperative filaments or bristles (110) onto and into which an item (130) may be placed, wherein the filaments (110) have a distal end (115) and a proximal end (120), the proximal end being affixed to a common base (125) and wherein at least a portion of the plurality of filaments are aligned to each other in a substantially parallel configuration.

Similar to as depicted in FIGS. 1C and 2C, in certain embodiments, the inventive method and system (100) comprises a plurality of cooperative filaments or bristles (110) wherein the filaments have a distal end and a proximal end, the proximal end being affixed to a common base (125) and wherein at least a portion of the plurality of filaments are aligned to each other in a substantially non-parallel configuration.

In certain embodiments, the inventive method and system (100) comprises a plurality of cooperative filaments or bristles wherein the filaments have a distal end and a proximal end, the proximal end being affixed to a common base and wherein at least a portion of the plurality of filaments are a natural material.

In certain embodiments, the inventive method and system (100) comprises a plurality of cooperative filaments or bristles wherein the filaments have a distal end and a proximal end, the proximal end being affixed to a common base and wherein at least a portion of the plurality of filaments are a synthetic material.

In certain embodiments, the inventive method and system (100) comprises a plurality of cooperative filaments or bristles wherein the filaments have a distal end and a proximal end, the proximal end being affixed to a common base and wherein at least a portion of the plurality of filaments are a polymer.

In certain embodiments, the inventive method and system (100) comprises a plurality of cooperative filaments or bristles wherein the filaments have a distal end and a proximal end, the proximal end being affixed to a common base and wherein at least a portion of the plurality of filaments are a plastic.

In certain embodiments, the inventive method and system (100) comprises a plurality of cooperative filaments or bristles wherein the filaments have a distal end and a proximal end, the proximal end being affixed to a common base and wherein at least a portion of the plurality of filaments are ridged.

In certain embodiments, the inventive method and system (100) comprises a plurality of cooperative filaments or bristles wherein the filaments have a distal end and a proximal end, the proximal end being affixed to a common base and wherein at least a portion of the plurality of filaments are semi-ridged.

In certain embodiments, the inventive method and system (100) comprises a plurality of cooperative filaments or bristles wherein the filaments have a distal end and a proximal end, the proximal end being affixed to a common base and wherein at least a portion of the plurality of filaments are flexible.

In certain embodiments, the inventive method and system (100) comprises a plurality of cooperative filaments or bristles wherein the filaments have a distal end and a proximal end, the proximal end being affixed to a common base and wherein at least a portion of the plurality of filaments are substantially straight.

In certain embodiments, the inventive method and system (100) comprises a plurality of cooperative filaments or bristles wherein the filaments have a distal end and a proximal end, the proximal end being affixed to a common base and wherein at least a portion of the plurality of filaments are substantially curved.

In certain embodiments, the inventive method and system (100) comprises a plurality of cooperative filaments or bristles wherein the filaments have a distal end and a proximal end, the proximal end being affixed to a common base and wherein at least a portion of the plurality of filaments are substantially configured in a spiral or corkscrew.

In certain embodiments, the inventive method and system (100) comprises a plurality of cooperative filaments or bristles wherein the filaments have a distal end and a proximal end, the proximal end being affixed to a common base and wherein at least a portion of the plurality of filaments are curved. In certain embodiments, the curvature of the filaments in projects inwards towards the center of the base.

In certain embodiments, the inventive method and system (100) comprises a plurality of cooperative filaments or bristles wherein the filaments have a distal end and a proximal end, the proximal end being affixed to a common base and wherein the plurality of filaments are of equal length.

In certain embodiments, the inventive method and system (100) comprises a plurality of cooperative filaments or bristles wherein the filaments have a distal end and a proximal end, the proximal end being affixed to a common base and wherein at least a portion of the plurality of filaments are of various lengths.

In certain embodiments, the inventive method and system (100) comprises a plurality of cooperative filaments or bristles wherein the filaments have a distal end and a proximal end, the proximal end being affixed to a common base and wherein at least a portion of the plurality of filaments are half the length of other cooperative filaments.

In certain embodiments, the inventive method and system (100) comprises a plurality of cooperative filaments or bristles wherein the filaments have a distal end and a proximal end, the proximal end being affixed to a common base and wherein the plurality of filaments are of the same circumference from distal to proximal end.

In certain embodiments, the inventive method and system (100) comprises a plurality of cooperative filaments or bristles wherein the filaments have a distal end and a proximal end, the proximal end being affixed to a common base and wherein the plurality of filaments are of one circumference at the distal end, and of another circumference at the proximal end.

In certain embodiments, the inventive method and system (100) comprises a plurality of cooperative filaments or bristles wherein the filaments have a distal end and a proximal end, the proximal end being affixed to a common base and wherein at least a portion of the plurality of filaments are half the length of other cooperative filaments.

In certain embodiments, the inventive method and system (100) comprises a plurality of cooperative filaments or bristles (110) capable of holding items (130) placed thereupon or therein due to density of the filaments (110), that is, the number of filaments per square inch, allowing an item to slip between the filaments (110) and rest on the common base (125) without causing deflection of the filaments by the item (130).

As depicted in FIGS. 1A and 1B, in certain embodiments, the inventive method and system (100) comprises a plurality of cooperative filaments or bristles (110) wherein the filaments have a distal end (115) and a proximal end (120), the proximal end being affixed to a common base (125) wherein the common base is flat.

As depicted in FIG. 1C, in certain embodiments, the inventive method and system (100) comprises a plurality of cooperative filaments or bristles (110) wherein the filaments have a distal end (115) and a proximal end (120), the proximal end being affixed to a common base (130) wherein the common base is curved.

As depicted in FIGS. 2A, 2B, and 2C, in certain embodiments, the inventive method and system (100) comprises a plurality of cooperative filaments or bristles (110) capable of holding in a suspended fashion items (130) placed thereupon or therein due to the cradling and/or deflection of the filaments (110).

As depicted in FIGS. 5A, 5B, and 5C, in certain embodiments, the inventive method and system (100) comprises a plurality of cooperative filaments or bristles (110) wherein the filaments have a distal end (115) and a proximal end (120), the proximal end being affixed to a common base (125); wherein at least two common bases (125 and 125') including identical or similar filaments or bristles (115 and 115') are used to "sandwich" and hold an item placed therebetween (FIGS. 5B and 6B).

Figure 4A:
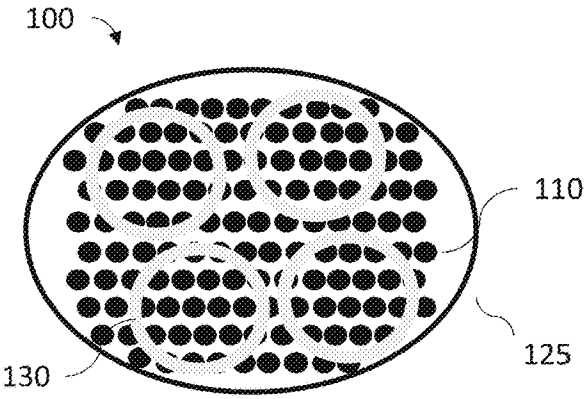
FIG. 4A is a top-view schematic diagram of an embodiment of the inventive system and method comprising a plurality of filaments or bristles affixed to a common base and holding items.
Figure 4B:
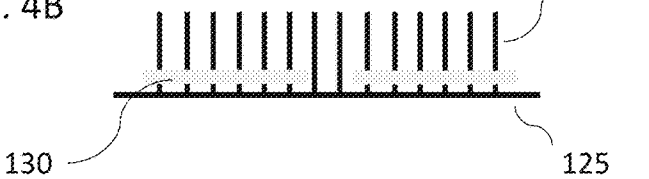
FIG. 4B is a side-view schematic diagram of an embodiment of the inventive system and method comprising a plurality of filaments or bristles affixed to a common base and holding an item.
Figure 3A:
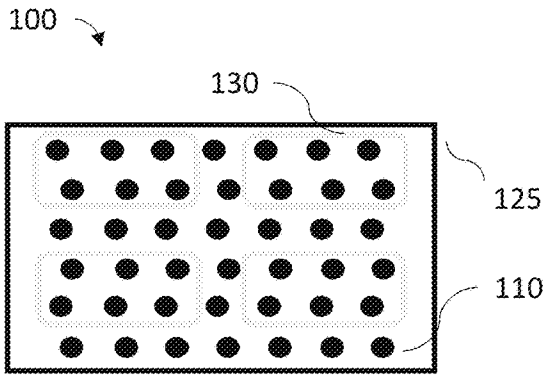
FIG. 3A is a top-view schematic diagram of an embodiment of the inventive system and method comprising a plurality of filaments or bristles affixed to a common base and holding items.
Figure 3B:
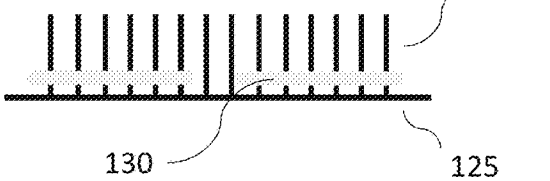
FIG. 3B is a side-view schematic diagram of an embodiment of the inventive system and method comprising a plurality of filaments or bristles affixed to a common base and holding an item.

As depicted in FIGS. 4A and 4B, in certain embodiments, the inventive method and system (100) comprises a plurality of cooperative filaments or bristles (110) wherein the filaments have a distal end and a proximal end, the proximal end being affixed to a common base (125) wherein the common base may be manufactured, cut, or trimmed to a preferred shape and area.

As depicted in FIG. 6A, in certain embodiments, the inventive method and system (100) comprises a plurality of cooperative filaments or bristles (110, 110') affixed to both sides of a common base (125).

As depicted in FIG. 6B, in certain embodiments, the inventive method and system (100) comprises a plurality of cooperative filaments or bristles (110, 110') affixed to both sides of a common base (125); whereby using one or more common bases (125), items (130) may be "sandwiched and stacked" for high density storage and/or shipping.

Having thus described several embodiments for practicing the inventive method, its advantages and objectives can be easily understood. Variations from the description above may and can be made by one skilled in the art without departing from the scope of the invention.

Accordingly, this invention is not to be limited by the embodiments as described, which are given by way of example only and not by way of limitation.

What is claimed is:

1. A system for holding, carrying, securing or transporting two or more fragile or valuable items, the system comprising:

a curved common base, the curve common base being curved upwards from a first end of the common base to a center of the common base, and downwards from the center of the common base to a second end of the common base, wherein the first end of the common base and the second end of the common base are in direct contact with a surface; and a plurality of bristles each having a distal end and a proximal end, the proximal ends of the plurality of bristles being affixed to the common base and the distal ends of the plurality of bristles projecting generally perpendicularly outwardly away from the common base, wherein the plurality of bristles configured to hold two or more items within the plurality of bristles and away from the curved common base and prevent the two or more items from contact with the curved common base and from contact with another item being held within the plurality of bristles, thereby protecting the two or more items from inadvertent damage or loss.

2. The system of claim 1 wherein the common base and/or at least a portion of the plurality of the bristles are configured to hold three or more items.

3. The system of claim 1 wherein the common base and/or at least a portion of the plurality of the bristles are configured to be used with and to improve known and existing holders or containers from the group consisting of: jewelry boxes, jewelry drawers, jewelry safes, compartmentalized boxes or cases, storage containers, shipping containers, and combinations thereof.

4. The system of claim 1, wherein the common base and/or at least a portion of the plurality of the bristles include a natural material.

5. The system of claim 1, wherein the common base and/or at least a portion of the plurality of the bristles include a synthetic material.

6. The system of claim 5, wherein the common base and/or at least a portion of the plurality of the bristles include a polymer or plastic.

7. The system of claim 1, wherein the common base and/or at least a portion of the plurality of the bristles are rigid.

8. The system of claim 1, wherein the common base and/or at least a portion of the plurality of the bristles are semi-rigid.

9. The system of claim 1, wherein the common base and/or at least a portion of the plurality of the bristles are flexible.

10. The system of claim 1, wherein the common base and/or at least a portion of the plurality of the bristles are substantially straight.

11. The system of claim 1, wherein the common base and/or at least a portion of the plurality of the bristles are substantially curved.

12. The system of claim 1, wherein at least a portion of plurality of the bristles project inwards towards the center of the common base.

13. The system of claim 1, wherein at least a portion of plurality of the bristles are of equal length.

14. The system of claim 1, wherein at least a portion of plurality of the bristles are of various lengths.

15. The system of claim 1, wherein at least a portion of plurality of the bristles are half the length of other cooperative filaments or bristles.

16. The system of claim 1, wherein at least a portion of plurality of the bristles are of one circumference at the distal end, and of another circumference at the proximal end.

17. The system of claim 1, wherein at least a portion of plurality of the bristles are of a number of bristles per square inch allowing an item to slip between the bristles and rest on the common base without causing deflection of the bristles by the item.

18. A method for holding, carrying, securing or transporting two or more fragile or valuable items, the method comprising the steps of:

providing a curved common base, the curve common base being curved upwards from a first end of the common base to a center of the common base, and downwards from the center of the common base to a second end of the common base, wherein the first end of the common base and the second end of the common base are in direct contact with a surface; and providing a plurality of cooperative bristles each having a distal end and a proximal end, the proximal ends of the plurality of cooperative bristles affixed to the curved common base and the distal ends of the plurality of cooperative bristles projecting generally perpendicularly outwardly away from the common base, the plurality of cooperative bristles being configured to hold two or more items within the plurality of cooperative bristles and away from the curved common base; and placing the two or more items within the plurality of bristles, the plurality of bristles configured to support the two or more items and prevent the two or more items from contact with the curved common base and from contact with another item being held within the plurality of cooperative bristles, thereby protecting the two or more items from inadvertent damage or loss.

19. The method of claim 18 wherein the common base and/or at least a portion of the plurality of the bristles are configured to hold more than one item.

* * * * *